United States Patent [19]

Taylor

[11] Patent Number: 4,750,677

[45] **Date of Patent: * Jun. 14, 1988**

[54] CLASSIFIER FOR COMMINUTION OF PULVERULENT MATERIAL BY FLUID ENERGY

[76] Inventor: David W. Taylor, P.O. Box 67, Edgmont, Pa. 19028

[ * ] Notice: The portion of the term of this patent subsequent to Jan. 27, 2004 has been disclaimed.

[21] Appl. No.: 907,307

[22] Filed: Sep. 12, 1986

Related U.S. Application Data

[63] Continuation of Ser. No. 757,825, Jul. 19, 1985, Pat. No. 4,638,953.

[51] Int. Cl.[4] ..... B02C 19/06

[52] U.S. Cl. ..... 241/5; 241/39

[58] Field of Search ..... 241/5, 39, 80, 79.1

[56] References Cited

U.S. PATENT DOCUMENTS 1,874,150 8/1932 Anger ..... 241/59

2,587,609 3/1952 Fisher ..... 241/80

4,219,164 8/1980 Taylor ..... 241/5

*Primary Examiner*—P. W. Echols

*Assistant Examiner*—Irene Cuda

*Attorney, Agent, or Firm*—Woodcock Washburn Kurtz Mackiewicz & Norris

[57] ABSTRACT

A fluid energy mill has an internal centrifugal classifier exhausting product-sized particulates entrained in fluid carrier medium such as steam. The classifier discharges oversized pulverulent material entrained in fluid carrier medium downward and outward into the sonic or supersonic discharge of fluid carrier medium from a plurality of centrally located nozzles. The nozzles create a grinding field directed outward and upward within a containment vessel at the top of which the mixed flow is directed radially inward by the containment walls. Turning vanes induce vorticity in the downward flow through the centrifugal classifier. A pipe disposed axially with the vessel exhausts the product stream and feeds raw pulverulent material into the mill.

9 Claims, 3 Drawing Sheets

CLASSIFIER FOR COMMINUTION OF PULVERULENT MATERIAL BY FLUID ENERGY

This is a continuation of application Ser. No. 757,825, filed July 19, 1985, now U.S. Pat. No. 4,638,953.

FIELD OF THE INVENTION

This invention relates to the comminution of pulverulent material by fluid energy and to classification of the ensuing flow to provide a product stream of suitably sized particulates entrained in spent carrier medium and a secondary flow of oversized pulverulent material entrained in carrier medium which is recirculated for further comminution with the addition of fresh pulverulent material feed.

BACKGROUND OF THE INVENTION

Pulverulent material has been subjected to reduction of particle size in fluid energy mills for many years, but the expense of such treatment has rendered it impractical for all except certain limited applications.

Fluid energy mills rely on the introduction of particulate material into a vessel having a high-velocity, normally sonic or supersonic velocity, fluid medium recirculating therein. The circulating flow of fluid medium is normally used to effect a centrifugal separation of the particulate material to permit a withdrawal of the finely ground material while the coarse material continues its recirculation. The coarse material is reduced in size either by impingement against other particles in the recirculating flow or else by impingement against the vessel walls. In the former case, there is considerable loss of energy in the prior art ways of causing the interparticle impingement, and in the latter case, there is substantial erosion of the vessel walls due to the high speed impact of the particles against the walls.

U.S. Pat. No. 4,219,164 reviews the then state of the art respecting fluid energy comminution and the problems associated with the practice thereof. That patent discloses a new and improved apparatus and method for fluid energy comminution comprising the injection of sonic velocity fluid through a plurality of nozzles located around the base of a cylindrical vessel directed inwardly and offset from a radius so as to provide a comminution zone and simultaneously induce a vortex which traverses upwardly the central portion of the vessel to provide a centrifugal field for the classification of the particulates in the flow. An axially disposed outlet at the top of the vessel allows the product stream, from which oversized particulate has been centrifuged, to exhaust, the remaining flow containing oversize particulate material entrained in carrier medium being recirculated outward and downward around the outer portion of the vessel to be entrained in the sonic flow issuing from the nozzles so as to again be subjected to comminution. New feed material is continually added to the system. Although this apparatus has been demonstrated to effectively produce large quantities of pulverulent product (over 20 tons per hour) difficulties have been experienced in maintaining proper nozzle alignment when using superheated steam as the carrier medium due to thermal distortion. Improper nozzle alignment causes distortions in the vortex and degrades classification. Furthermore, spurious secondary circulation flows have from time to time been found to interfere with proper operation. Lastly, the inward flow of sonic velocity carrier medium limits the throughput capacity, which may be less than that desired.

SUMMARY OF THE INVENTION

In accordance with the present invention apparatus is provided which incorporates flow and circulation containment so as to prevent spurious secondary circulation and which is relatively insensitive to nozzle alignment. The arrangement of operating features is such that very high throughput capacities can be accommodated.

More specifically, the present invention incorporates a plurality of nozzles centrally disposed at the base of a cylindrical vessel from which issue sonic or supersonic fluid carrier medium outwardly and upwardly intercepting a generally downward return flow comprising pulverulent material suspended in fluid carrier medium exhausted from the classification zone together with newly added feed pulverulent material. As momentum interchange is effected between the nozzle discharge and the recirculation flow in the comminution field, and the velocity of the combined flow diminishes in the upper reaches of the radially outward portion of the vessel, the flow is directed by the containment means radially inward and downward in a vortex which occupies a generally cylindrical volume within the comminution field and coaxial with the vessel. The vorticity is imposed by horizontal inclination of the nozzles to induce an angular momentum of the comminution field about the vertical axis of the vessel, by turning vanes installed in the upper reaches in the vessel, or both.

As the vortex flow descends vertically downward through the central portion of the vessel, larger particles are centrifuged towards its outer diameter while product-sized particles remain suspended in the carrier medium at the inner diameter of the flow. A vertical pipe is located coaxial with the vessel, penetrating the top of the vessel and extending downwardly. The product stream of product-sized particulate suspended in carrier medium is exhausted through this pipe, the inlet of which is at an elevation between that of the nozzles and the top of the vessel. That portion of the vortex flow containing oversized pulverulent material suspended in carrier medium which is not exhausted is returned to the comminution field together with additional fresh pulverulent material which is added intermediate of the bottom of the exhaust pipe and the comminution field.

Fresh pulverulent material is fed through a coaxial pipe inside the exhaust pipe and extending below the bottom of the exhaust pipe so the discharge will not contaminate the product stream.

The classification zone is isolated physically from the comminution field by means of a metal shell.

SHORT DESCRIPTION OF THE DRAWINGS

DETAILED DESCRIPTION

U.S. Pat. No. 4,219,164, gives a detailed description of the mechanism of comminution by fluid energy together with empirical information respecting wear and erosion by high velocity two phase flows comprising fluid carrier media and entrained pulverulent material.

Figure 1:
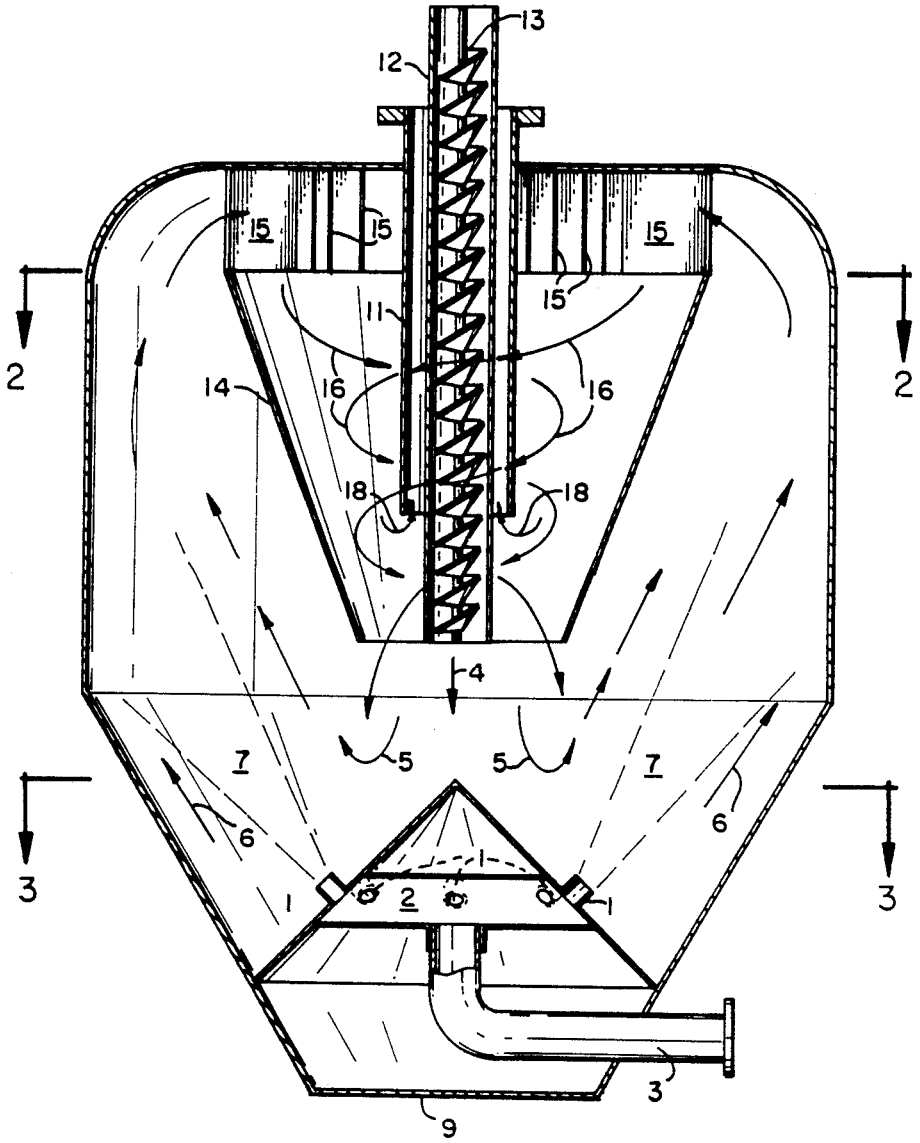
FIG. 1 is a view in side elevation with a portion broken away of the fluid energy mill embodying the present invention.

The mill shown in FIG. 1 accomplishes efficient and effective size reduction with no high velocity particle impingement on containment surfaces and effects classification within physical containment which prevents spurious secondary circulation flows from imposing deleterious effects. To this end the apparatus in FIG. 1 includes an upright vessel whose walls are symmetrical about an axis of rotation comprising a lower portion 8 whose walls are tapered to a truncated bottom 9, a dished head 10 and a cylindrical section 17 between the lower portion and the top.

Primary fluid carrier, such as steam, at elevated pressure, is supplied to pipe 3, whence it is delivered to manifold 2 onto which are mounted nozzles 1 through which the fluid carrier is expanded to sonic or supersonic velocity. This high velocity primary flow 7 intercepts the discharge flow 5 from classifier 14, together with fresh feed 4 delivered from feeder 12, sweeping it upward and outward. The high velocity flow 7 and the low velocity flow 6 rapidly mix into a uniform flow of relatively low velocity by virtue of the momentum interchange between the relatively low mass high velocity nozzle discharge and the relatively high mass of the heavily particle laden recirculation discharge from the classifier to which has been added the fresh pulverulent feed.

Comminution is achieved during this mixing of flows and momentum interchange process. The relatively low velocity mixed flow intercepts the containment wall 17 and the top 10. It is turned radiaIly inward around the top of the vessel entering classifier 14 through vanes 15 which are disposed so as to direct the flow tangentially within said classifier. Vanes 15 are adjustable to achieve the desired tangential flow in the classifier.

The resulting vortex flow descends within the classifier centrifuging the particles of greater mass to the outer diameters thereof whilst particles of lower mass are retained within the inner diameters. At an elevation between the top of the classifier and its bottom 18 the product stream exhausts from the system through pipe 11 which is mounted coaxially within the vessel.

The remaining flow 5 which contains oversized pulverulent material discharges downwardly and outwardly (by virtue of its angular momentum) back into the grinding field imposed by the high velocity discharge 7 from nozzles 1.

A fresh supply of pulverulent material is continuously introduced into the vessel through feed pipe 12 mounted coaxially within product discharge pipe 11. A rotating screw 13 is operated within the feed pipe to insure continuous and uninterrupted flow. A rotary air lock (not shown) may be installed to meter the flow of feed into pipe (12) and to prevent any discharge of superatmospheric carrier medium.

Figure 2:
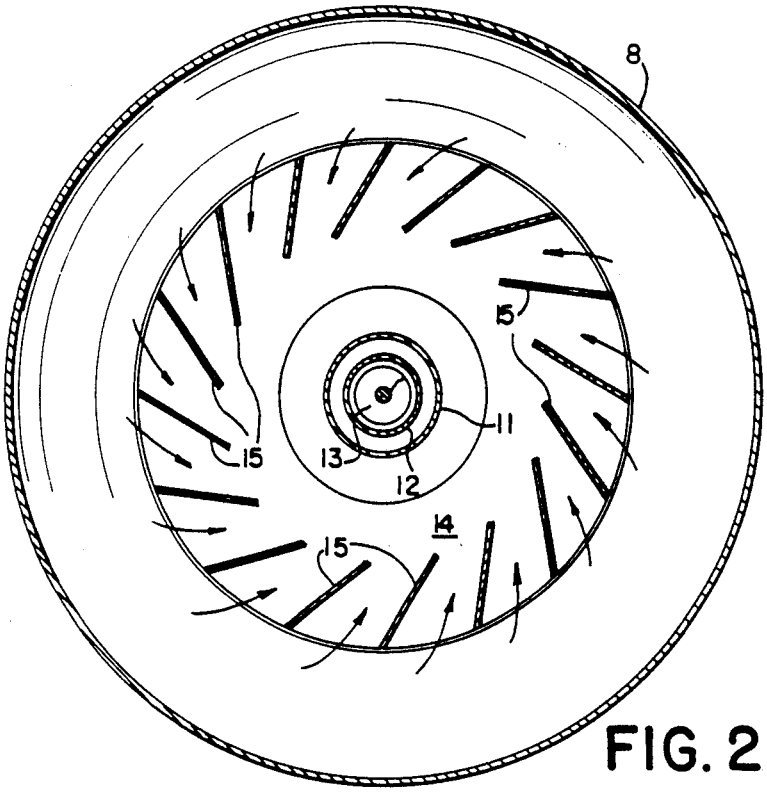
FIG. 2 is a section on the line 2—2 of FIG. 1.

FIG. 2 is a section through the lower portion of the mill and shows the plan view of the nozzle disposition and the horizontal component of the discharge therefrom.

Figure 3:
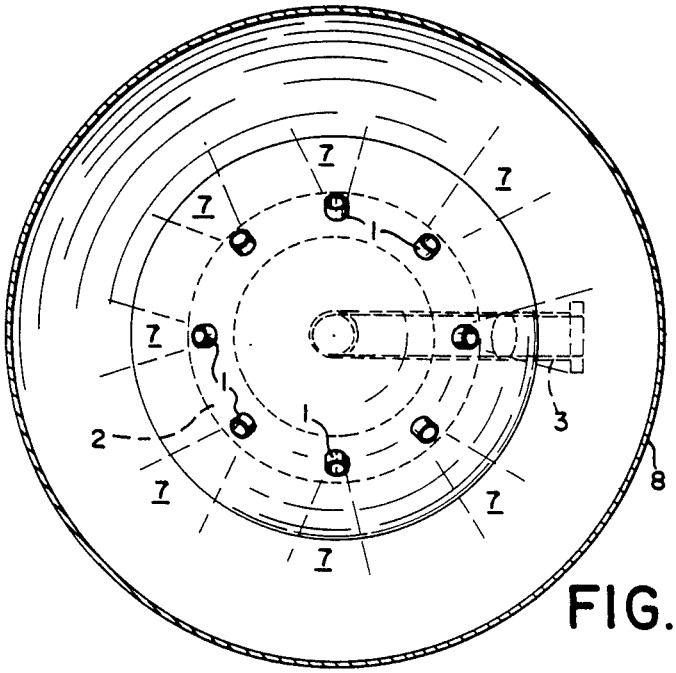
FIG. 3 is a section on the line 3—3 of FIG. 1.

FIG. 3 is a section through the upper portion of the vessel and shows the disposition 15 of the turning vanes through which the grinding field discharge enters the classifier 14.

Figure 4:
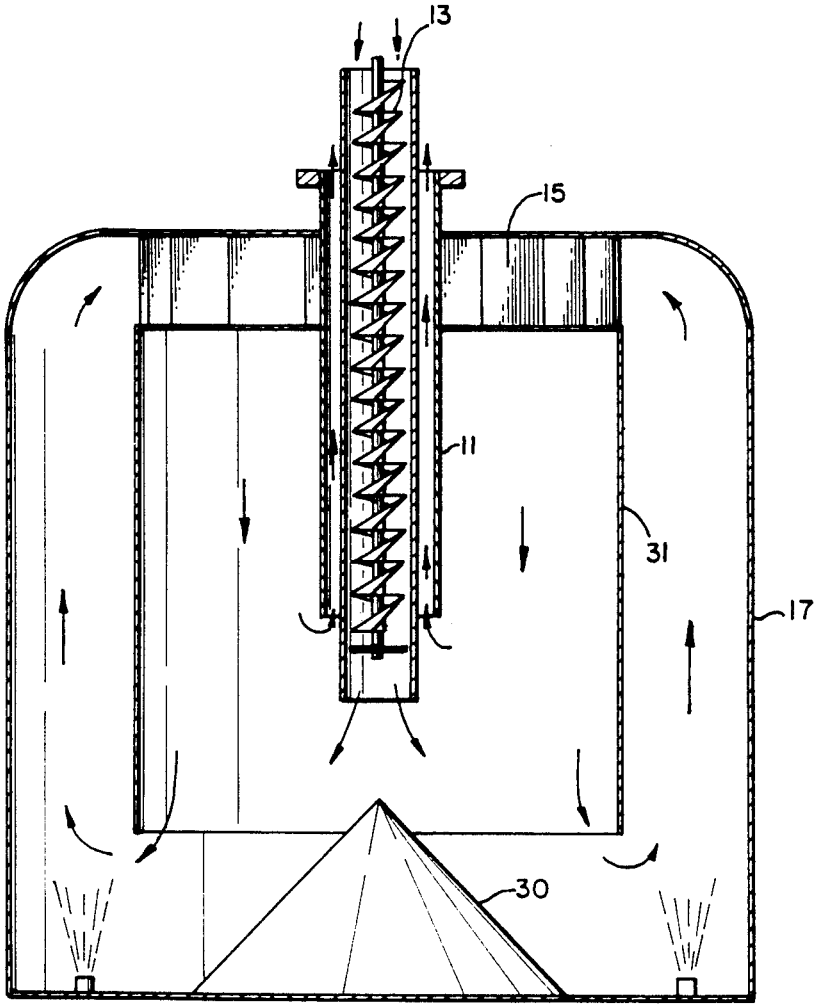
FIG. 4 shows an alternative embodiment of the invention.

FIG. 4 illustrates one embodiment of the invention wherein a plurality of nozzles discharge sonic velocity steam in a vertical direction into the recirculation flow of coal dust entrained in steam. In this design, 60 nozzles with a throat diameter of $\frac{1}{4}''$ are employed. 30,000 pounds per hour of steam at 700° F. and 200 pounds per square inch pressure is distributed to these nozzles from a manifold (not shown) wherefrom it discharges at a velocity of about 1950 feet per second. The outer diameter of the vessel is 60 inches and its height is 60 inches. Auger 13 delivers 40,000 pounds per hour of coal through a 6" feed pipe 12 into the vessel through feed pipe 12 onto distributor 30 and it falls by gravity and is swept by the recirculation flow into the grinding field. The recirculation load comprises about 80,000 pounds of coal and about 60,000 pounds of steam per hour so that the total flow traversing the grinding field as about 120,000 pounds of coal and about 90,000 pounds of steam per hour. Centrifugal separator 31 has an outer diameter of 50 inches to provide a annular grinding area such that the vertical veloxity of the combined sonic velocity steam, raw coal feed and recirculating load will achieve a mixed flow velocity of about 100 feet per second in the upper reaches of the mill before entering the turning vanes for introduction into the centrifugal classifier. Likewise, the turning vanes 15 are 6 inches high so that the exhaust from the grinding field enters the centrifugal separator at 100 feet per second tangential velocity which is considered optimal. The product stream exhausted through 18" exhaust pipe 11 is 40,000 lbs. coal/hr. and 30,000 lbs. of steam/hr.

While a particular embodiment of the invention has been shown and described, various modifications are within the true spirit and scope of the invention. The appended claims are, therefore, intended to cover all such modifications.

What is claimed is:

1. A method of comminuting pulverulent material comprising:

circulating a primary stream of carrier fluid in a vessel by discharging carrier fluid from a plurality of nozzles into said vessel, the direction of discharge of said carrier fluid from each of said nozzles being substantially nonconvergent with respect to the other of said nozzles;

grinding said pulverulent material between said primary stream and a lower velocity secondary stream of carrier fluid containing said pulverulent material;

classifying said pulverulent material according to mass in a rotational flow in the middle of said circulating stream of carrier fluid; and isolating said circulating stream of carrier fluid from said rotational flow to prevent spurious secondary circulation.

2. A fluid energy mill for grinding pulverulent material comprising:

(a) a vessel;

(b) a plurality of nozzles for introducing a circulating stream of carrier fluid into said vessel, each of said nozzles being disposed so as to discharge said carrier fluid in a substantially nonconvergent direction with respect to the other of said nozzles;

(c) means for feeding fresh pulverulent material into said stream;

(d) means for classifying comminuted pulverulent material contained within said stream; and (e) means for removing a portion of said classified material from said stream.

3. The fluid energy mill of claim 2 wherein each of said nozzles is disposed so as to discharge said carrier fluid in a direction which is substantially parallel to the direction of discharge of the other of said nozzles.

4. The fluid energy mill of claim 3 wherein said nozzles are disposed so as to discharge said carrier fluid in a generally upward direction.

5. The fluid energy mill of claim 2 wherein: said vessel is a vertical vessel whose walls are symmetrical about an axis of rotation, said vessel having a closed bottom at one end and a closed top at the other end; and said plurality of nozzles are annularly disposed at said bottom of said vessel.

6. The fluid energy mill of claim 5 wherein said means for classifying comprises a centrifugal classifier axially coincident with said vessel at the top thereof.

7. The fluid energy mill of claim 6 further comprising inlet guide veins at the top of said classifier for directing said circulating stream of carrier fluid tangentially within said classifier to create a vortex flow which centrifuges the larger particles of said comminuted pulverulent material to the outer diameters of said classifier while the smaller particles of said communited pulverulent material are retained within the inner diameters of said vortex flow.

8. The fluid energy mill of claim 7 wherein said classifier has containment walls which separate said vortex flow from said circulating stream of carrier fluid.

9. The fluid energy mill of claim 8 wherein said nozzles are disposed so as to discharge said carrier fluid in a direction which is substantially parallel to said vessel walls.

* * * * *